United States Patent [19]

Wipkink et al.

[11] 4,169,296

[45] Oct. 2, 1979

[54] CONNECTING BRIDGE FOR PERSONNEL TO CONNECT TWO MUTUALLY MOVABLE MARINE STRUCTURES

[75] Inventors: Johannes Wipkink, Sassenheim, Netherlands; Harald Johansen, Stavanger, Norway

[73] Assignees: Ingenieursbureau Marcon (Marine Consultants) B.V., The Hague, Netherlands; Peder Smedvig Shipowners, Stavanger, Norway

[21] Appl. No.: 888,807

[22] Filed: Mar. 21, 1978

[51] Int. Cl.[2] ..... E01D 1/00

[52] U.S. Cl. ..... 14/71.1; 14/35; 14/37; 405/220

[58] Field of Search ..... 14/71.1, 1, 69.5, 35, 14/37; 214/15; 182/82; 61/48; 16/163

[56] References Cited

U.S. PATENT DOCUMENTS

| | | | |
|---|---|---|---|
| 329,249 | 10/1885 | Werner | 14/2 |
| 409,700 | 8/1889 | Pegram | 14/35 X |
| 534,704 | 2/1895 | Worden | 14/37 |
| 785,400 | 3/1905 | Buchanan | 14/71.1 X |
| 1,358,951 | 11/1920 | Helmich | 14/1 X |
| 2,367,291 | 1/1945 | Le Tourneau | 14/1 |
| 2,527,653 | 10/1950 | Pierce | 14/71.1 |
| 2,556,175 | 6/1951 | Frost | 14/37 X |
| 2,641,785 | 6/1953 | Pitts | 14/71.1 |
| 3,208,086 | 9/1965 | Gillois | 14/27 X |
| 3,747,354 | 7/1973 | Macomber | 14/71.1 X |
| 3,846,860 | 11/1974 | Kummerman | 14/71.1 |
| 3,879,784 | 4/1975 | Kummerman | 14/71.1 |
| 3,884,043 | 5/1975 | Timmermans | 14/71.1 X |
| 3,933,256 | 1/1976 | Fagerlund | 14/71.1 X |
| 4,011,615 | 3/1977 | Maxson | 14/71.1 |
| 4,035,861 | 7/1977 | Edge | 14/71.1 |
| 4,083,072 | 4/1978 | Ryan | 14/69.5 |

*Primary Examiner*—Nile C. Byers, Jr.

*Attorney, Agent, or Firm*—Sughrue, Rothwell, Mion, Zinn and Macpeak

[57] ABSTRACT

A personnel bridge for connecting a stationary offshore working platform 1 to a floating housing platform 2. A first span 3 is vertically pivoted at 5 to the platform 1 on one end, and vertically pivoted at 6 to the outer end of a second span 4 whose inner end is mounted to the platform 2 by a ball joint 8. The outer ends of the spans 3, 4 are also connected through a horizontal pivot axis 7, whereby movements between the platforms 1, 2 in three mutually orthogonal directions may be accommodated. The spans may be supported from a tower 10 by a fixed cable 9 pivotable at one end about an axis 11 aligned with the vertical axis 5, and by a winch controlled cable 12.

21 Claims, 13 Drawing Figures

CONNECTING BRIDGE FOR PERSONNEL TO CONNECT TWO MUTUALLY MOVABLE MARINE STRUCTURES

This invention relates to a connecting bridge for personnel to connect two marine structures which are mutually movable in more than one direction. For safety reasons a situation is developing in which, voluntarily or under changing laws, the personnel of marine structures offshore such as drilling and production platforms and artificial islands, floating or resting on the seabed, are given accommodation on another marine structure at a distance from the structure on which the personnel have their daily work and on which they may be subjected to dangers for instance in view of fire. This means that there will be two marine structures at some distance, say at a minimum distance of 20 m and usually about 50 m. The situation will often be so that at least one of said marine structures is of a floating type. There will thus be mutual movements between said marine structures by waves, currents of water and wind, and the movement of one structure, if both are floating, may at any moment be different from the movements of the other structure in amplitude, phase and direction.

In view thereof the present invention aims at providing a connection for the personnel between such structures in the shape of a bridge, which in an advantageous and safe way will constitute a safe connection for personnel between said structures also in storms and high seas.

In view thereof a connecting bridge for connecting such marine structures at least say 20 m apart is according to the invention characterized in that it consists of at least two parts connected mutually by a vertical pivot axis, of which parts one is pivotally connected to one of the said marine structures and the other being pivottally connected to the other marine structure. Preferably there is also a horizontal pivot axis or two mutually perpendicular pivot axes near the vertical pivot axis in the zone where the two bridge parts are connected.

When applying a bridge according to the invention it will be made and mounted in such a way that the total length of the bridge parts is considerably more than the distance between the two marine structures, the bridge parts having a mutual angle as seen in a horizontal plane differring considerably from 180°, for instance with an average of about 90° or somewhat less, so that also considerable variations in mutual distance between the marine structures can easily be taken up and followed by the bridge. By the horizontal and vertical pivoting axes the bridge is adapted to follow both horizontal and vertical mutual movements between the marine structures in such a way that the passage of the bridge by personnel also during storms and in cases of emergency is safely possible, adapted to the amplitudes and frequencies of said mutual movements.

It will be clear that care has to be taken that the bridge structure itself on the one hand maintains a position suited for easy passage of personnel in view of rotations of the bridge about the longitudinal axis of the bridge parts, and on the other hand the connection with the marine structures should be such that not too high torsional loads will have to be taken up by the bridge. This makes it necessary to apply a sufficient number of possibilities of pivoting, i.e. a sufficient number of pivoting axes and on the other hand not too much pivoting movements of bridge parts mutually about axes in their longitudinal direction. Preferably such problems are according to the invention solved by having the bridge part connected to one of the marine structures only pivot about a vertical axis with respect to said structure. Preferably such a vertical pivoting axis only is chosen for the connection of the bridge to that marine structure, to which the bridge remains connected if it has to be disconnected from one of the structures. On this marine structure having the vertical pivoting axis only it is thus easy to mount means to take up part of the weight of the bridge for instance by a strut or cable system also pivoting around the same vertical axis as the adjacent bridge part but connected to said marine structure in a point higher than the bridge. The strut or cable system may extend to the free end of the adjacent bridge part.

Pivoting gangways are known, for instance for ports with jetties or piers in which differences of water level in view of the tide have to be taken up when connecting a floating vessel to a quay of wharf providing accommodation leathers and gangways for personnel. Such gangways usually have a horizontal pivot axis transverse to its longitudinal direction. For considerable possible differences in height gangways may be applied consisting of mutually pivoting parts, which not only have horizontal pivot axes between the ship and the quay but also sometimes a vertical pivot axis between two parts to allow some freedom of bridging horizontal distances, but such structures bridge more vertical than horizontal distance, are embodied as staircases and are not suited for bridging horizontal distances of at least 20 m and usually 50 m or more. Moreover, personnel bridges are known from airfields for connections to airplanes and these may also have horizontal and vertical pivoting axes, but in use they are stationary and they are only movable by mechanical driving means at rather low speed and only to bring them in the desired stationary position.

Between marine structures bridges have been applied consisting of one rigid bridge connected pivotably about a horizontal and a vertical axis to one of the marine structures, the other end being for instance horizontally movable to and from the opposite marine structure on wheels running on the deck. Such structures are not adapted to bridge considerable distances, the possibilities of movement are limited and it has appeared that horizontal movements between such marine structures may be so considerable and may take place at such a speed that personnel stepping onto or from the bridge from or onto at least one of the marine structures may be difficult and even dangerous. The present invention on the contrary is particularly adapted to bridge considerable distances safely, also with considerable mutual movements. In the airfield bridges the pivoting centre is supported on the platform and one of the bridge parts has a telescoping part to make the connection with an airplane.

The present invention also relates to different preferred embodiments of structures according to the invention relating to the bridge itself, its supports and pivoting structure, as will be described in more detail with reference to the enclosed drawings giving several preferred embodiments of the bridge according to the invention.

Figure 1:
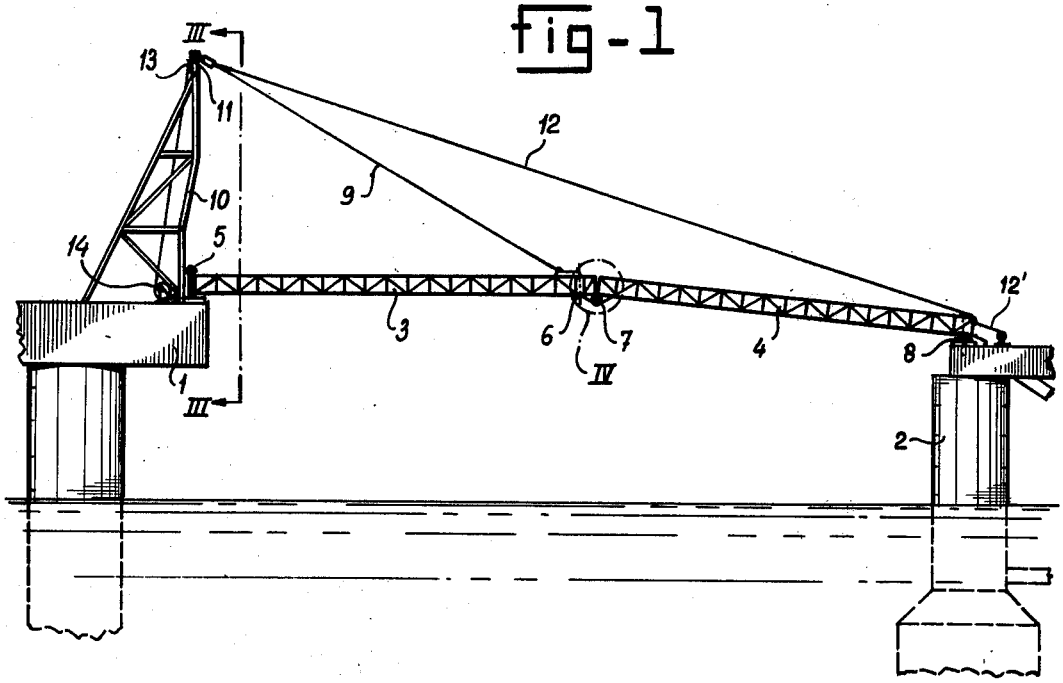
FIG. 1 shows a sideview of a bridge according to the invention with adjacent parts of two marine structures in a first embodiment.
Figure 3:
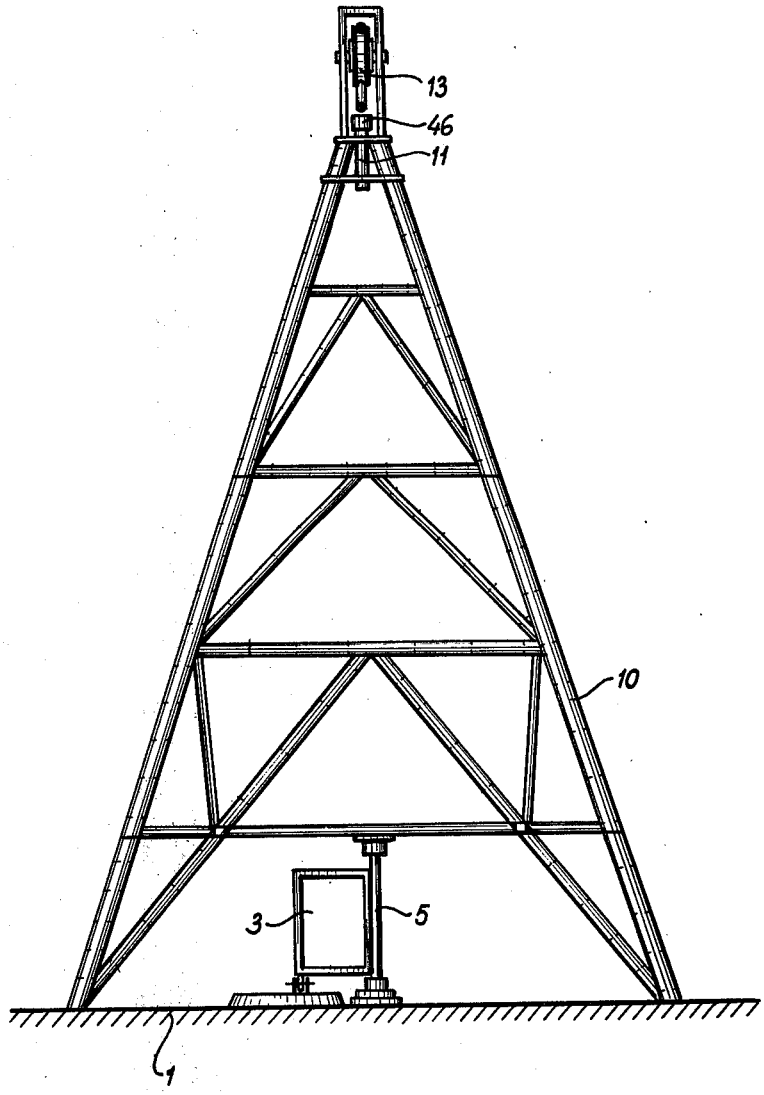
FIG. 3 shows a detail on a larger scale along the line III—III in FIG. 1.
Figure 4:
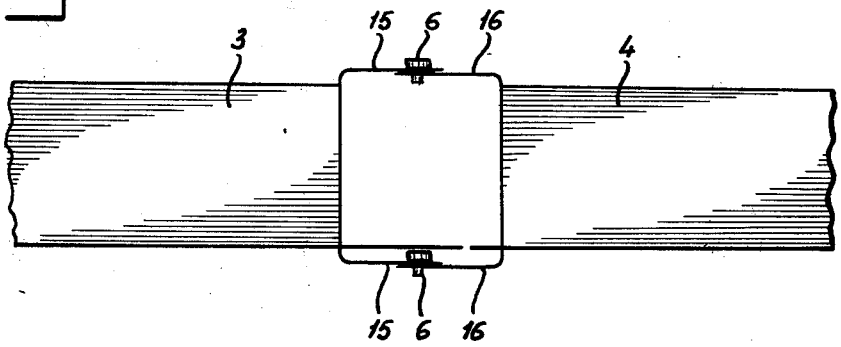
Figure 5:
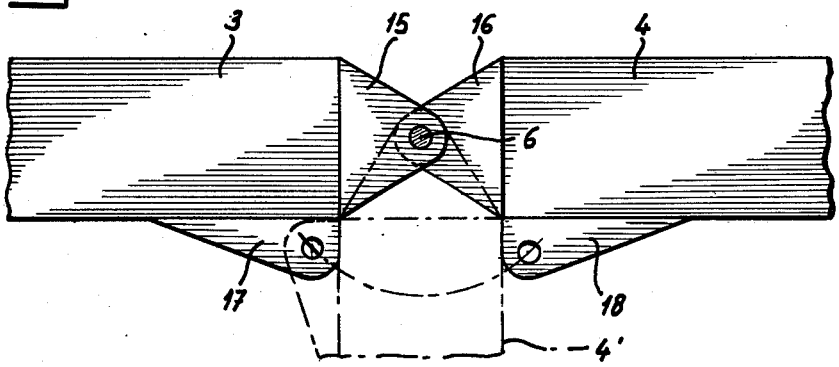
Figure 6:
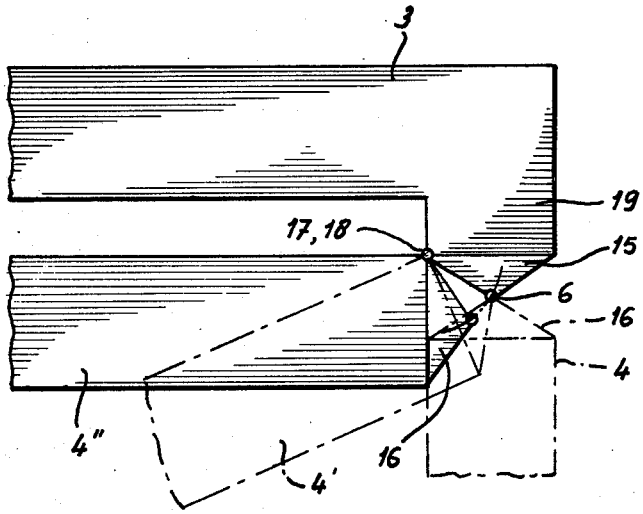
Figure 7:
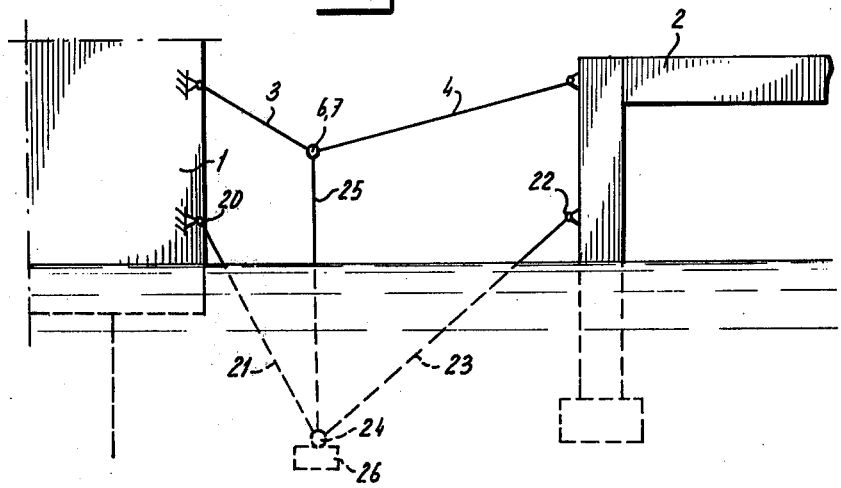
Figure 8:
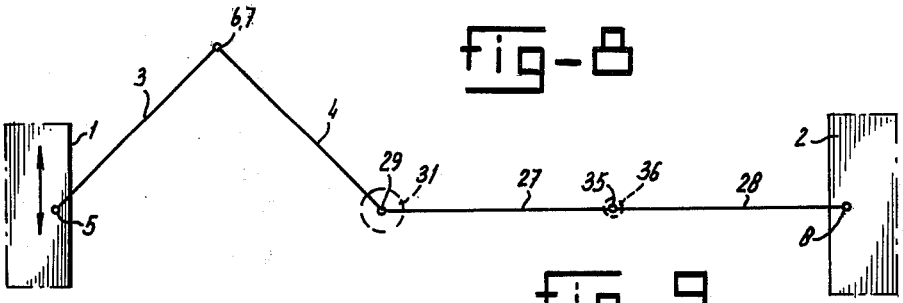
Figure 9:
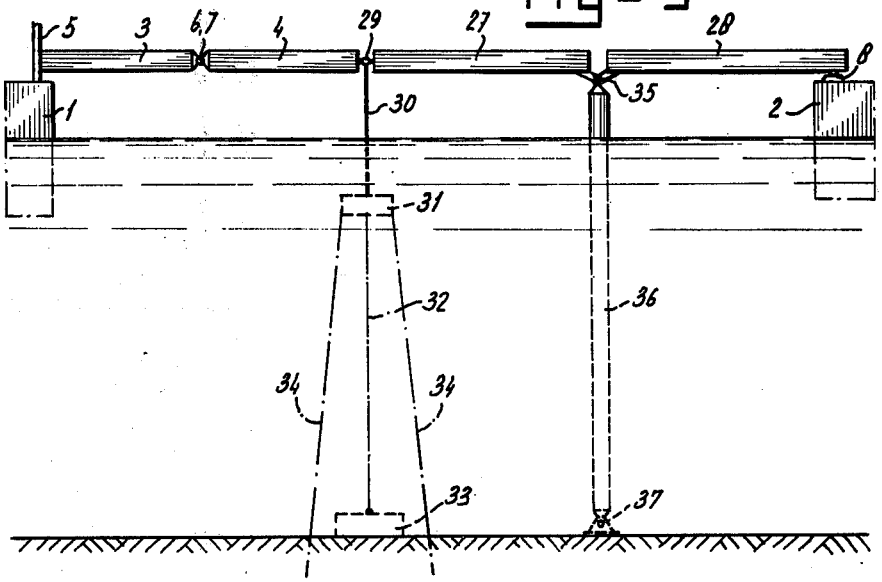
Figure 10:
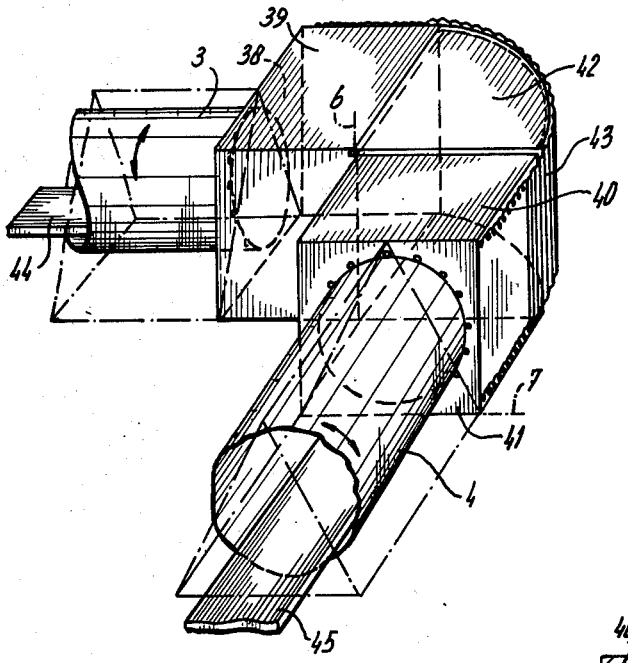
Figure 11:
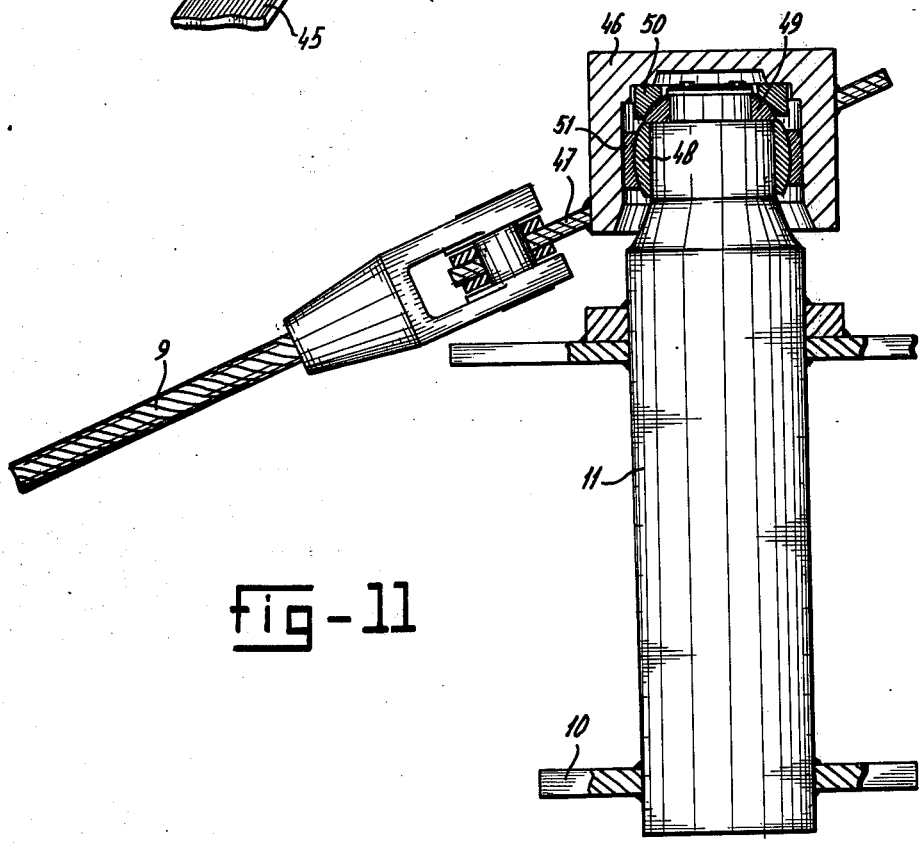
Figure 12:
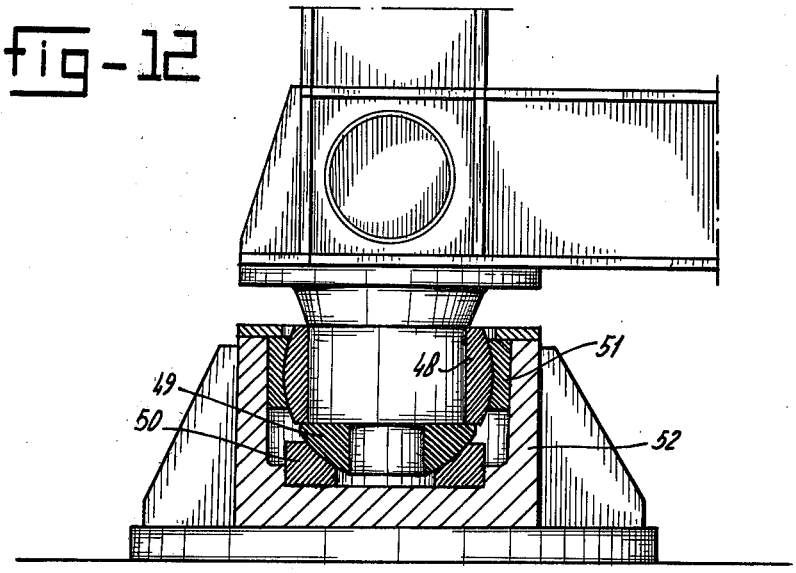
Figure 13:
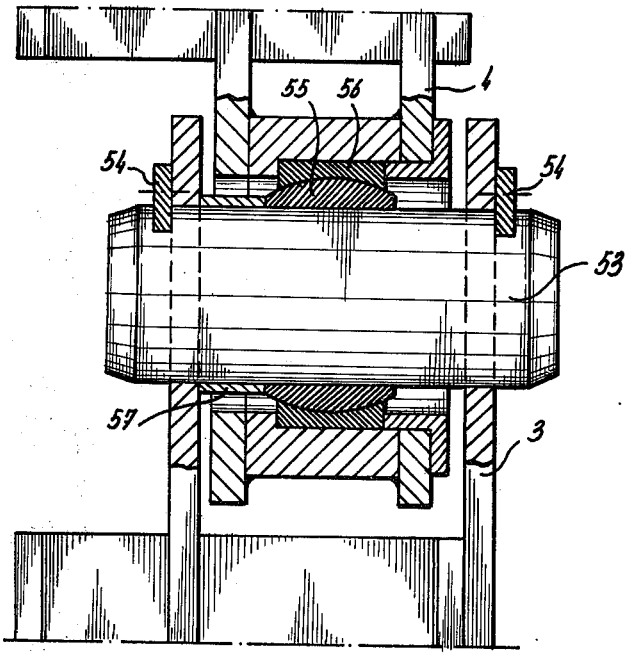

FIG. 4 gives a diagrammatic elevation through the connection between the bridge parts near the centre of the bridge as shown by the dot and dash circle IV in FIG. 1, but in a somewhat different embodiment;

FIG. 5 is a view from above of the bridge parts in the detail of FIG. 4;

FIG. 6 is a diagrammatic view from above of a bridge according to the invention in a different embodiment;

FIG. 7 is a diagrammatic elevation of a bridge according to the invention in a further different embodiment;

FIG. 8 is a diagrammatic view from above of a long bridge according to the invention from four mutually pivoting parts;

FIG. 9 is a diagrammatic elevation of the bridge of FIG. 8;

FIG. 10 is a perspective view of the pivoting connection between adjacent bridge parts in a further embodiment;

FIG. 11 is a vertical section and view of a pivoting cable support in the top of the structure of FIG. 3;

FIG. 12 is a vertical section through a pivot structure applied in a bridge according to the invention; and FIG. 13 is a section, which may be both horizontal or vertical, through a pivot structure in a different embodiment.

Figure 2:
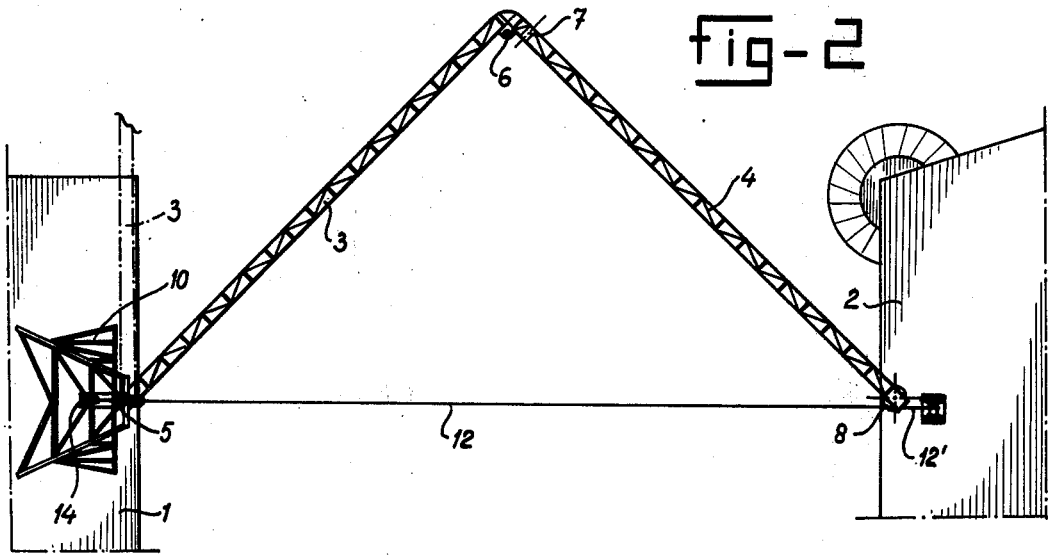
FIG. 2 is a view from above of said bridge of FIG. 1.

The bridge according to FIG. 1 and 2 gives a walking connection for personnel between for instance a platform 1 which may be supported by the seabed on legs, and a floating semi-submersible platform 2, applied for living accommodation of personnel working on platform 1. Platform 1 for instance is used for production, storing and treating of oil. Instead thereof the structure 1 may be a ship or floating platform for drilling purposes or it may be a structure for production of other minerals etc.

The bridge mainly consists of two parts 3 and 4. Part 3 is rotatably connected to platform 1 at 5 about a vertical axis only. At 6 bridge part 3 is connected to bridge part 4 in a way so as to be pivotable about a vertical axis. In said bridge part 4 there is close to pivoting axis 6 a horizontal pivoting axis 7. At 8 bridge part 4 rests on a ball joint for instance of a structure as shown in detail in FIG. 12 to be supported by the deck of structure 2. Instead of a ball joint another pivoting structure is of course applicable, for instance a universal joint with two horizontal axes and with freedom of rotation about a vertical axis. In this structure the walking surface of the bridge will take up an inclination, which in one direction is the same as the inclination of the work deck of structure 1. This is particularly advantageous if said work deck always remains horizontal for instance when structure 1 rests on the seabed. If structure 1 is floating, the said inclination of the walking surface of the bridge in one direction will vary with variations in position of the work deck of structure 1, and it is of course advantageous to choose for the marine structure to which the vertical axis of the bridge is mounted that structure of the two which has the smallest movements by waves and wind. The bridge will always adequately follow all movements of structure 2. Up and down movements thereof with respect to structure 1 are taken up by the pivoting axes at 7 and 8 and the vertical pivoting movements will be able to take up differences in distance between the two structures caused by such mutual movements. Tilting movements of structure 2 will be taken up in the same way. Horizontal movements of structure 2 towards and away from structure 1 are taken up by vertical pivoting axes 5 and 6 and at 8, the angle between the bridge parts 3 and 4 in a horizontal plane changing therewith, and horizontal movements of structure 2 in a direction transverse to the line of connection between the ends of the bridge are also taken up by said vertical pivoting axes.

There are thus in all six degrees of freedom for the different movements, one in pivoting axis 5 on structure 1, two in axes 6 and 7 where the bridge parts 3 and 4 are mutually connected and three at ball joint 8 on structure 2, and this about three mutually perpendicular axes thereof.

Near the "free" end of bridge part 3 a strut or cable system 9 is connected thereto, said system 9 being pivotable in the upper part of tower 10 mounted on structure 1 at 11, and this pivoting takes place about the same vertical axis as bridge part 3, which means that the axis of said movement at 11 is in the same line as pivoting axis 5 for the bridge part 3 (FIG. 1 and 3). Bridge part 3 itself is thereby considerably freed from load in a vertical direction by its own weight, by the personnel etc. A cable 12 may run over pulley 13 in the top of tower 10, is connected with one end to the end of bridge part 4 above structure 2 and is at its other end connected to a winch 14 on the deck of structure 1. It is thereby possible to loosen bridge part 4 from structure 2 and to draw it towards structure 1 and it also facilitates moving of the bridge from structure 1 towards structure 2 if this is desired. This allows assembly and disassembly, for instance when structure 2 has to be towed or moved by own force for instance to a port for repair purposes. When doing this, another cable 12′ connecting the end of bridge part 4 at 8 to structure 2, may be paid out under tension for instance by a winch on structure 2, to control the movements of the bridge to let them take place slowly and gradually when moving towards structure 1 after loosening from structure 2. Of course it is possible to have cable 12 be present only during such movements and not in normal operation, in which there is no need for such a cable.

The bridge parts in FIG. 1 to 3 consist of a frame structure in which there is a walking floor, and there may be a shielding at the sides and at the top against wind and rain to protect personnel crossing the bridge. Preferably such a shielding is not fully closed to give good ventilation and to avoid draught of flames and smoke longitudinally through the passageway of the bridge.

In FIG. 2 the pivoting axis 6 is shown as present on the inside of the elbow formed by bridge parts 3 and 4. This has the advantage that the bridge parts 3 and 4 may be moved towards each other so as to lie alongside each other if they are loosened from one of the structures 1, 2 and are supported only by the other structure and also when they have to be transported or repaired. If however, for instance for purposes of strength, it is desired to make the bridge parts pivot mutually about an axis near the centre of their width, while it is also required to maintain the possibility of moving them to a position alongside each other as described in an easy way, a structure according to FIG. 4 and 5 may be preferred. Such diagrammatic Figures show that the vertical pivoting axis 6 of FIGS. 1 and 2, about which the bridge parts pivot mutually in normal operation, is positioned in the centre of the width of the bridge. Arms 15 on bridge part 3 and 16 on bridge part 4 engage horizontally one along the other and have lugs or eyes to take up vertical pivot pins in axis 6.

In this structure there are other parts for forming another pivoting connection about a vertical axis, formed by brackets 17 for bearing lugs on bridge part 3 and brackets 18 for such bearings on bridge part 4. These are mounted to the side of the bridge parts as shown. If bridge parts 3 and 4 are pivoted about axis 6 so as to reach a position in which the brackets 18 slide along the brackets 17 to make the lugs for the pivot pins coaxial, it is possible to introduce pivot pins through such coaxial openings in brackets 17 and 18. In FIG. 5 it is clear that this position is reached if bridge part 4 reaches position 4' with respect to bridge part 3, i.e. a position where bridge part 4 is turned about 90° with respect to bridge part 3. After introducing such pivot pins through the openings in brackets 17 and 18 it is possible to remove the pivot pins in axis 6 and thereafter it is possible to turn bridge parts 3 and 4 further mutually until they are substantially parallel and positioned alongside each other, for transporting, repair and other purposes. Such pivot pins may have a handle at their upper end to be manipulated easily by personnel for introduction and removal. Of course, after mounting such pins may be locked by suitable locking means to secure their staying in place.

In FIG. 6, showing diagrammatically the parts of the bridge where they meet, there is a somewhat different embodiment, based on the principle that in normal operation the bridge parts will not be in the same line but will already make a considerable angle say of about 90° as shown in FIG. 2. Here the bridge 3 has a sharp bend 19 over 90° towards pivoting axis 6. In this case, bridge part 4 can turn about pivoting axis 6 much farther than in FIGS. 4 and 5, viz. into position 4'. The same would be possible in essence in the embodiments of FIGS. 4 and 5 by making the arms 15 and 16 longer, so that axis 6 is farther outside the end of the adjacent bridge parts, but such a solution has disadvantages from a design and strength viewpoint and there is still a considerable limitation of the pivoting angle.

If it is desired to loosen the bridge of FIG. 6 from one of the structures and to transport it, it is now possible to introduce pivot pins at 17, 18, where there are brackets with lugs in essence in the same sense as in FIG. 5, and the pins at 6 can now be removed, after which bridge part 4 may be turned further into position 4". Also in this case it would be possible to make the arms 15, 16 longer, so that the pivoting connection at 17, 18 may entirely be omitted, but this has some secondary disadvantage as to the design of the walls of the bridge.

FIG. 7 shows diagrammatically that the bridge parts 3 and 4 may be connected at 6, 7 by a column 25 through a pivoting structure with three mutually perpendicular axes of pivoting, for instance a universal joint with two horizontal axes, one of the parts being connected thereto by a vertical pivoting pin. In this case the column 25 extends downwardly, for instance to a point above or near the water surface or to a point below such level, and this column is connected at 24 by a pivoting structure with three mutually perpendicular pivoting axes to a bracing 21 connected at 20 pivotally to marine structure 1, and to a bracing 23 connected at 22 pivotally to marine structure 2. Below such pivoting structure at 24 there is a float 26 giving a floating force vertically upwardly to column 25 to support the bridge 3, 4 near the centre. The float 26 is entirely submerged. There could be used a float at the water surface, but in most cases this is not preferred.

If the marine structures 1 and 2 move only in such a way mutually that their vertical axis remains vertical and that their mutual position remains at the same height, no high requirements have to be made for the pivoting connections at the ends of brackings 21 and 23 and at the ends of column 25: such structures may be in essence of the same design as door hinges with only a vertical pivoting axis. As however in practice more complicated movements will occur, the column 25 should be allowed to take up a somewhat inclined position with respect to the vertical direction and the bracings 21 and 23 should be allowed to adapt their positions thereto. Several pivoting structures at the ends of such bracings and column should thus allow some movement about more than one axis. It will be clear that the float 26 has to take up only part of the weight of the bridge parts and this may be less than half thereof. It is moreover possible also in this structure to apply a strut or cable system as indicated at 9 in FIG. 1 to support one-bridge part or both parts from a marine structure to a point close to the pivoting structure 6, 7.

FIGS. 8 and 9 show diagrammatically a bridge from four parts 3, 4, 27 and 28, applied when greater distances have to be bridged between marine structures 1 and 2, for instance distances of more than 70 m. In this case, bridge parts 3 and 4 are connected to structure 1 and to each other (6, 7) in the same way as indicated and described above. At 29 there is a pivoting structure which may include two pivoting axes just as pivoting structure 6, 7 (vide FIGS. 1 and 2), viz. a vertical axis and a horizontal axis transverse to the length direction of one of the bridge parts. A column 30 may support pivoting structure 29 and this column has a float 31 below the water surface. This float may be connected by a flexible tension structure 32 from cables or chains to a heavy weight anchoring structure 33 resting on the seabed, or there may be guys 34 anchored in the seabed, or both. The connection between bridge parts 27 and 28 takes place by a pivot structure 35 resting on a column 36, which at 37 is supported on the seabed in such a way as to be pivotable in all directions. The column 36 may have buoyancy itself in order to stand upright even after loosening at 35, and, if desired, in order to float towards the surface after loosening at 37. All types of combinations between such structures for bridges in more than two parts are possible, allowing a long bridge to be articulated more than by two parts only. It is of course possible to support the left end of bridge part 28 by a strut or cable from structure 2 in the same way as bridge part 3 is supported by 9 in FIG. 1.

In general it is preferred to connect the bridge parts in such a way that they cannot rotate mutually about an axis in the longitudinal direction thereof, but if this would give too much torsional loads it is possible to have such a pivoting possibility about a longitudinal axis, if only the angular displacements in amplitude and speed remain so small that there is no danger for the personnel if they have to pass the bridge rapidly in case of emergency.

In FIG. 10 such a possibility of mutual rotation about the longitudinal axis of one of the bridge parts is shown. Here the bridge parts 3 and 4 consist of or include apart from a frame structure cylindrical tubes to surround the walking passage. The tube of bridge part 3 is adapted to rotate at 38 in a casing 39 which supports pivoting axis 6, giving a connection to pivoting casing part 40 having horizontal pivot axis 7 at its lower outer edge. This axis 7 connect casing 40 to end wall 41, in which the tube of bridge part 4 is adapted to rotate. Between the casings 39 and 40 there is an elbow structure 42 with floor and ceiling parts sliding alongside each other, with a flexible displaceable outer wall 43, embodied for instance as an articulated flexible wall from vertical steel parts, which wall during pivoting movements of the bridge parts 3 and 4 about axis 6 will extend more or less along the outer wall of casing 39 and/or casing 40, there being for instance cables pulling on said wall 43 and keeping it extended. FIG. 10 shows such parts as helical springs along top and bottom of casing part 40. There may also be folding panels or the like to constitute wall 43.

In view of the pivoting possibility about horizontal axis 7 there may also be folding or bellow parts between the end of casing part 40 and the end wall 41, in which the tube of bridge part 4 is adapted to rotate.

The tubes 3 and 4 may be supported in the structures 39 and 41 by rollers all around the periphery of the tubes of the bridge parts with flanges to allow only a mutual rotation without other movements. At their other end such tubular bridge parts 3 and 4 may be connected to one of the marine structures or to the pivoting structure of another bridge part rigidly. The walking boards 44 and 45 in the bridge parts may be connected thereto so as to rotate therewith if the rotations are not considerable. It is however also possible to make such floors 44 and 45 slidable within the tubes 3 and 4, for instance by supporting rollers or balls and to connect them rigidly at one end to walking floors, for instance on a marine structure 1 or 2 or to the casing parts 39 and 40. A rigid connection at both ends is not always possible in view of torsional loads, but there are cases in which such a rigid connection is nevertheless possible because such floors 44 and 45 are long and so torsion is easily taken up over a considerable length without too high stresses and without disadvantage for personnel using the bridge.

FIG. 10 also shows in dot and dash lines that the bridge parts may have a triangular cross section with the top of the triangle at the top, so that the wind will mainly exert downward forces thereon. Any other shape desired in view of wind forces is possible, such as the shape of a trapezoid, a non-symmetrical oval shape or other shape of the cross section. Bridge parts of such shape may also terminate in a circular annulose, where rotation with respect to a pivot casing or a marine structure is possible, but in that case the floor can of course not be supported by rollers or the like onto and in the bridge structure and provisions have to be made to bridge the angular rotations in the floor without disadvantage to the personnel, for which the expert knows many solutions.

FIG. 11 shows the connection of cable system or strut 9 of FIG. 1, in this case a system of for instance four cable one to the side of the other, in the top of the tower 10. The vertical pivot pin 11 extends with its axis in the same centre line as the centre line of the pivot axis 5 below it, about which bridge part 3 is pivotable. On pivot pin 11 there is a self-adjusting bearing with axial thrust block formed by a sleeve 46, to the outer surface of which an inclined plate 47 is welded, to which the cables of system 9 engage on to the side of the other. Either here or near the connection thereof to the end of bridge part 3 there may be a well-known equalizer structure such as a sheave to compensate for differences in length of the cables and to maintain even distribution of the loads among the cables as is known as such. The thinner end of pin 11 carries an inner sleeve 48 of the bearing with a spherical outer surface, and a thrust bearing ring 49 with a spherical outer surface with the same centre. In bearing sleeve 46 the other thrust bearing ring 50 is arranged, together with the bearing ring 51 of the radial bearing being concave internally. The ring 51 is free to slide somewhat axially in sleeve 46.

FIG. 12 shows a self-adjusting bearing of about the same type, but applicable to the lower ends of vertical pivot axes like 5 and 6. Also in this case the sleeve 51 is free to adjust itself somewhat axially, in this case in the bore of bearing bracket 52.

FIG. 13 shows a bearing with a horizontal pivot axis and this structure may be used in connecting the parts in the horizontal pivot axes in several points of the structure like in axis 7. However, this same structure may be used with pivot pin 53 in a vertical position in several vertical pivoting axes like 6. This pivot pin 53 is secured in its axial direction by locking plates 54 to avoid movement with respect to one of the bridge parts which it connects. Around pin 53 there is a self-adjusting bearing with an inner ring 55 and an outer ring 56. Inner ring 55 is free to slide over pin 53. A sleeve 57, however, avoids movement of ring 55 in one direction.

There may be two such pins 53 in line with each other at top and bottom of pivot axis 5 or 6 in the vertical embodiment and two such pins 53 one to the side of the other in the same axis for pivot axis 7. Whether in such cases a sleeve like 57 will be used and to what side of the ring 55 will depend upon the question what forces have to be transmitted between the bridge parts or other parts to both sides of the pivot structure. As there is only a sleeve 57 to one side of ring 55 or no sleeve 57 at all, there is the possibility to have the structure give a good support without high stresses due to bending, flexion, torsion, heat expansions etc. For the horizontal embodiment it may be preferred to use one sleeve 57 in one bearing to one side of the bridge and a sleeve 57 to the other side of ring 55 in the bearing at the other end of the concerning pivot axis.

The structure shown in FIG. 12 may be used as the bearing 8 for bridge 4 on marine structure 2 on the condition that the angular movements in other directions than around the vertical axis for a self-adjusting bearing are sufficient in view of the mutual movements between the marine structures 1 and 2. Such a bearing may be used at 8, but with the omission of rings 49 and 50 of FIG. 12. In that case the bearing itself is not adapted to transmit vertical forces and the ring 51 may move up and down in its bore, and the vertical forces may be taken up by rollers or wheels below the bridge resting on the deck of the marine structure 2 at a distance outwardly from the bearing of FIG. 12. For mutual tilting movements between bridge part 4 and the deck of marine structure 2 such wheels or rollers may have springs to push them downwardly and may be movable up and down with respect to the bridge part. If the movements of bridge part 4 with respect to the marine structure 2 in a direction tilting about the longitudinal axis of bridge part 4 are very small, such springs may be omitted and the wheels or rollers may be rigidly connected to the bridge part 4, the bridge part 4 itself being adapted to take up torsion from such movements, or there may be a rotating structure of the bridge part 4 with respect to the pivot structure where it is connected to bridge part 3 as shown in FIG. 10.

There may always be provisions to loosen the bridge from one of the marine structures and to connect it safely to the other marine structure as described above. The position of pivot axis 5 in FIGS. 1 and 2 to one side of the bridge (vide FIG. 3) instead of in the centre of the width, and the retracted shape of the tower 10 in the lower part as clearly seen in FIG. 1 allow a retraction of the bridge part 3 into the position shown in dot and dash lines in FIG. 2. Bridge part 3 may thus rest on the deck of marine structure 1 and the bridge in total, together with bridge part 4 will not protrude far from the marine structure. FIG. 3 shows how below bridge 3 opposite pivot axis 5 there may be rollers or wheels supporting this side of the bridge on the deck of structure 1. If desired there may be a slight pivoting movement possibility of bridge part 3 with respect to marine structure 1 about a horizontal axis extending transversely to the length of bridge part 3, which is desired may not be used in situations where the bridge is connected to marine structure 2, but which may be used for lowering bridge part 3 with a part near its other end near pivot axis 6 onto the deck of structure 1 to support it in a better way. In such a case the strut or cable system 9 (FIGS. 1 and 11) may have a sheave system, which may be paid out a little to lower the bridge somewhat at the end near axis 6, for instance over a distance of 30 cm.

Locking and connecting means may be used to secure the bridge to one of the structures if it is disconnected from the other structure.

It will appear from the above that the bridge itself may be a frame structure with a separate floor and walls and ceiling in it, or the bridge may be a box-like structure or tube in which the floor, the walls and if desired also the ceiling aid in giving strength thereto.

A tower like tower 10 in FIG. 3, but normally lower, may also be built on bridge parts themselves to support the bridge by a cable or strut like 9 or 12 in FIG. 1. Such a tower may e.g. be mounted at the end of bridge part 3 to support the opposite end of bridge part 4, or at one end of other bridge parts such as 4, 27 and 28 in FIGS. 8 and 9.

We claim:

1. A personnel bridge for connecting first and second marine structures spaced apart in a horizontal direction by at least 20 meters and subject to relative movement therebetween, comprising:

(a) a first bridge span pivotally connected at one end to the first marine structure, (b) a second bridge span pivotally connected at one end to the second marine structure, and (c) means connecting the other ends of the first and second bridge spans together for mutual pivotal movement about a vertical axis in response to variations in the horizontal spacing between the first and second marine structures.

2. A bridge according to claim 1, further comprising horizontal pivot axis means connecting the first and second bridge spans together adjacent the vertical pivot axis.

3. A bridge according to claim 2, wherein there are two mutually perpendicular horizonal pivot axes between the bridge spans.

4. A bridge according to claim 2, wherein the one end of the first bridge span is pivotable only about a vertical axis.

5. A bridge according to claim 4, further comprising a tower upstanding from the first marine structure and carrying at a point above the bridge a mount for support means extending to a point near the other end of the first bridge span to take up at least part of the load of said bridge.

6. A bridge according to claim 5, wherein said support means mount has a vertical pivot axis coaxial with the pivot axis of the one end of the first span.

7. A bridge according to claim 6, wherein the one end of the second span is pivotally connected to the second marine structure by a support rotatable about a vertical and two mutually perpendicular horizontal axes.

8. A bridge according to claim 7, wherein said rotatable support is a ball joint.

9. A bridge according to claim 8, wherein said ball joint is resiliently supported to yield with tilting movements of said second marine structure.

10. A bridge according to claim 2, wherein the vertical pivot axis between the bridge spans is positioned at the inside of an angle formed between the spans in normal operation.

11. A bridge according to claim 10, wherein the bridge spans also have a second mutual vertical pivot axis, extending about midway across the width of the bridge spans, there being two sets of lugs and pivot pins, one set for each axis, each adapted to be connected and disconnected so as to have the bridge operate about the midway axis in normal operation and about the axis at the inside of the angle between the bridge spans when folding the bridge spans to a position one alongside the other.

12. A bridge according to claim 2, further comprising a buoyant body connected to and supporting the bridge between its ends.

13. A bridge according to claim 2, wherein the bridge is pivotably connected to a column below it supported by the seabed.

14. A bridge according to claim 13, wherein the bridge has more than two mutually pivotably connected bridge spans.

15. A bridge according to claim 3, wherein the bridge spans have a cross-sectional shape which is non-symmetrical with respect to a horizontal plane, whereby wind forces give a downward force on the bridge.

16. A bridge according to claim 7, wherein said rotatable support includes a self-adjusting spherical bearing.

17. A bridge according to claim 6, wherein said support means mount includes a self-adjusting spherical bearing with a vertical axis and with an inclined plate rigid with the outer casing of the bearing and connected to the means for taking up part of the load of the bridge.

18. A bridge according to claim 6, wherein the vertical pivot axis of the one end of the first span is constituted by two structures, one at the lower end and one near the upper side of the bridge, transmitting vertical loads from one side of the pivot structure to the other only in one of these structures, by a self-adjusting spherical bearing with axial thrust bearing means.

19. A bridge according to claim 3, wherein the bridge has a horizontal pivot axis comprising two structures one near each laterally opposite side of the bridge, there being some freedom of axial movement in the pivot axis of each structure between the pivotally connected parts.

20. A bridge according to claim 2, wherein each bridge span is a tube including a walking floor, said tube being connected rotatably about its axis to another part of the bridge or to a marine structure near its one end and being non-rotatably connected to such a part at its other end.

21. A bridge according to claim 20, wherein the walking floor is rotatably supported in and with respect to the tube.

* * * * *